US005472052A

United States Patent [19]

Head

[11] Patent Number: 5,472,052

[45] Date of Patent: Dec. 5, 1995

[54] METHOD OF ABANDONING A WELL AND APPARATUS THEREFOR

[76] Inventor: Philip F. Head, 6 Leith Mansions, Grantully Road, London W9 1LQ, England

[21] Appl. No.: 261,259

[22] Filed: Jun. 17, 1994

[30] Foreign Application Priority Data

Jun. 19, 1993 [GB] United Kingdom ..... 9312727

[51] Int. Cl.[6] ..... E21B 43/00

[52] U.S. Cl. ..... 166/298

[58] Field of Search ..... 166/55–55.8, 285, 166/297, 298

[56] References Cited

U.S. PATENT DOCUMENTS 4,339,000 7/1982 Cronmiller ..... 166/297 X 4,510,999 4/1985 George et al. ..... 166/297

4,688,640 8/1987 Pritchard .

*Primary Examiner*—Michael Powell Buiz

*Attorney, Agent, or Firm*—Herbert Dubno

[57] ABSTRACT

The invention relates to a method of abandoning a well which has ceased to provide economic use. The method includes pressurizing the well fluids through the production tubing including optionally additional adjacent annular channels to force them back into the reservoir by means of a gaseous medium such as nitrogen. Then sealing the production tubing and optional annular channels with a suitable seal. Draining the remaining channels by perforation into the void in the production tubing and optional channels formed by the gaseous medium. Followed by a final sealing of the whole well.

20 Claims, 19 Drawing Sheets

METHOD OF ABANDONING A WELL AND APPARATUS THEREFOR

FIELD OF THE INVENTION

This invention relates to the abandonment of wells which is required when production has ceased due typically to the production level being so low that the well can no longer be run economically. Oil wells which are typically located offshore usually carry a higher maintenance cost and therefore will reach the point of abandonment sooner than land-based oil wells. However the present invention is applicable to land-based oil wells as well as to offshore oil wells.

BACKGROUND OF THE INVENTION

Over the past 20 years or so a large number of offshore structures have been constructed which are now or will soon be exhausted and will need to be abandoned. These offshore structures may comprise production platforms which are either steel or concrete structures resting on the sea bed or floating platforms. Numerous conduits are connected to these offshore structures to carry the various fluid, e.g. gas, oil or water etc., which are necessary for the production of oil and/or gas from the well, In abandoning a well, consideration has to be given to the potential environmental threat from the abandoned well for many years in the future.

In the case of offshore structure there is usually no rig derrick in place which can be used to perform the required well abandonment procedure. Therefore it is typically necessary to install a new derrick or alternatively a mobile derrick can be positioned above the well. This requirement adds considerable expense to the to the task of abandoning the offshore well, compared to a land-based well.

A typical production well will comprise a number of tubular conduits arranged concentrically with respect to each. The method of abandoning the well which is presently known in the art involves the separate sealing of each of the concentric conduits which requires a large number of sequential steps.

In the abandonment method known in the art the first step is to seal the first central conduit usually by means of cement or other suitable sealant. The first annular channel between the first and second conduits is then sealed and the first central conduit is then cut above the seal and the cut section is removed from the well.

The second annular channel between the second and third conduits is then sealed and the second conduit cut above the seal and the cut section is removed from the well.

This process is repeated until all the conduits are removed. The number of separate steps required is typically very large indeed and the number of separate operations is five times the number of conduits to be removed. This adds considerably to the cost of the well abandonment due to the time taken and the resources required at the well head.

OBJECTS OF THE INVENTION

It is the object of the present invention to provide a method of abandoning a well which avoids the disadvantageous and numerous operations which are required by the existing known methods. This will greatly reduce the costs of safely abandoning a well. It is a further object of the invention to provide a method of abandoning a well without the requirement of a rig which involves significant expense particularly in sea-based wells.

It is a further object of the invention to isolate all the conduits and annuli with no return of the well bore or annular fluids to the surface. Additionally if required all tubing and casing can remain in the well. Further more the method of abandonment of the well should comply with all the regulatory guidelines for the isolation of a well.

SUMMARY OF THE INVENTION

The method of abandoning a well according to the invention, said well comprising at least two concentric conduits comprising at least one annular channel therebetween, which contains well fluids and other fluids associated with oil production, comprises the steps of:

a. Applying pressure in the innermost conduit or production tube of the well by means of a gaseous medium, such as nitrogen, in order to force the well fluids back into the reservoir to create a void which is filled by the gaseous medium.

b. Perforating at least one of the innermost concentric conduits to allow the fluids contained in the at least one annular channel to drain into the void created by the gaseous medium.

The method of abandoning a well according to the invention, said well comprising at least two concentric conduits with at least one annular channel therebetween, which contains well fluids and other fluids associated with oil production, may alternatively comprises the steps of:

a. Perforating the innermost concentric conduit to connect the internal conduit or production tube with the first annular channel.

b. Applying pressure in the innermost conduit or production tube and in the first annular channel of the well by means of a gaseous medium, such as nitrogen, in order to force the well fluids back into the reservoir to create a void which is filled by the gaseous medium.

The method of abandoning a well according to the invention also includes that a delayed setting cement is poured into the internal conduit prior to the application of pressure by the gaseous medium.

The method of abandoning a well according to the invention includes providing a layer of elastomeric material located above the delayed setting cement prior to the application of pressure by the gaseous medium.

The method of abandoning a well according to the invention includes the further step that at least one further conduit is perforated at a point above the level of the well fluids in the innermost conduit in order to drain the fluids in the at least one further annular channel into the innermost conduit and into the annular channel or channels which are in between the said further annular channel and the innermost conduit.

The method of abandoning a well according to the invention which in addition requires that at least one further channel is perforated at a point above the level of the well fluids in the innermost conduit such that there is sufficient volume in the innermost conduit, as well as in any annular channels connected thereto by existing perforations, that when the fluids contained in the at least one further annular channels drain into the innermost conduit and annular channels connected thereto, the resulting level of fluids remains below the point of perforation of the at least one further channel.

According to the invention a first mechanical check valve is provided in the inner conduit to permit flow down into the reservoir but to prevent flow back into the inner conduit. Additionally a second mechanical check valve is provided at a predetermined distance above the first mechanical check valve.

According to the invention a plug 125 is provided in the internal channel 112, or alternatively in the first annular channel 114 prior to the application of pressure by the gaseous medium.

According to the invention plug 125, 127 is a burst plug disc assembly, or alternatively, in particular if the plug is placed in the first annular channel, a cross linked gel, high viscosity gel.

According to the invention following pressurization, cement is applied to the well in the gaseous medium and pumped into the required position. The cement can pass through the plug 125, or alternatively if the plug is made of a high viscosity gel, can push the gel through the mechanical check valve.

According to a further aspect of the invention the method of abandoning a well comprises the following steps.

a. perforating at least one of the conduits at the point where the well is to be abandoned, b. purging or flushing the annular channels with a suitable fluid at the required pressure, c. sealing the annular channels with a suitable sealant.

d. cutting completely through the said at least one conduit, and e. removing the said at least one conduit.

Thus by means of the method according to the invention the number of operations required is greatly reduced thus resulting in a considerable reduction in the cost of carrying out the well abandonment.

According to a further aspect of the perforating device according to the invention the perforating device is adapted to permit the pumping of sealant to the area where the seal is required.

According to a further aspect of the invention a method of sealing a well, said well with at least two concentric conduits with at least one annular channel therebetween, comprises the steps of:

a. perforating the said at least two of the conduits at the point where the well is to be abandoned, and b. sealing the said at least one annular channel with a suitable sealant.

SPECIFIC DESCRIPTION

Figure 1:
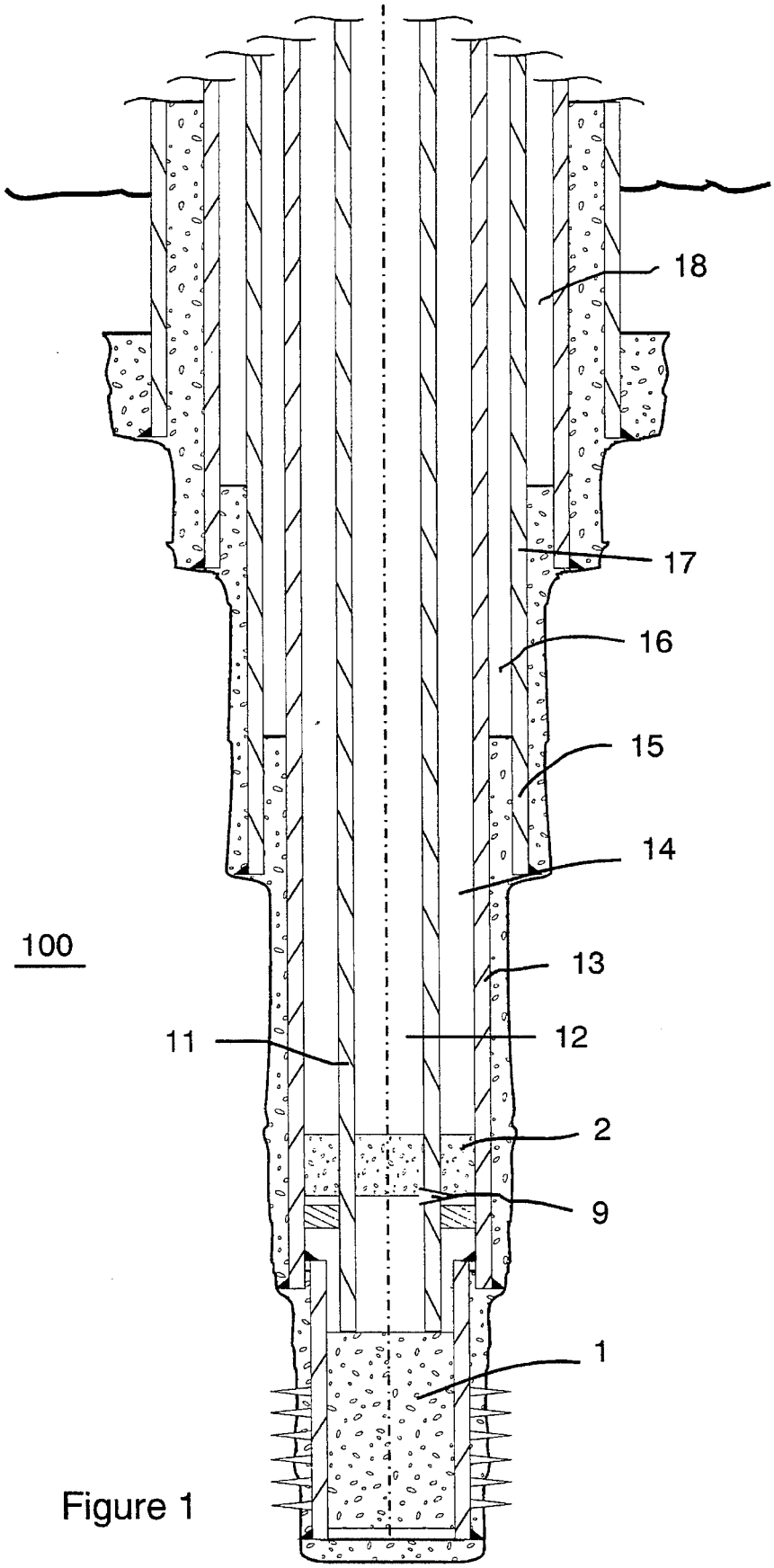
FIG. 1 is a side view of a typical well showing steps 1 to 2 of a conventional well abandonment.

FIGS. 1 to 4 show a method of abandoning a well which is conventionally used. Referring to FIG. 1 the well comprises a first conduit 11, a second conduit 13, a third conduit 15, a fourth conduit 17 and a fifth conduit 19. Between each of the conduits annular channels 12, 14, 16, 18 are defined.

Figure 2:
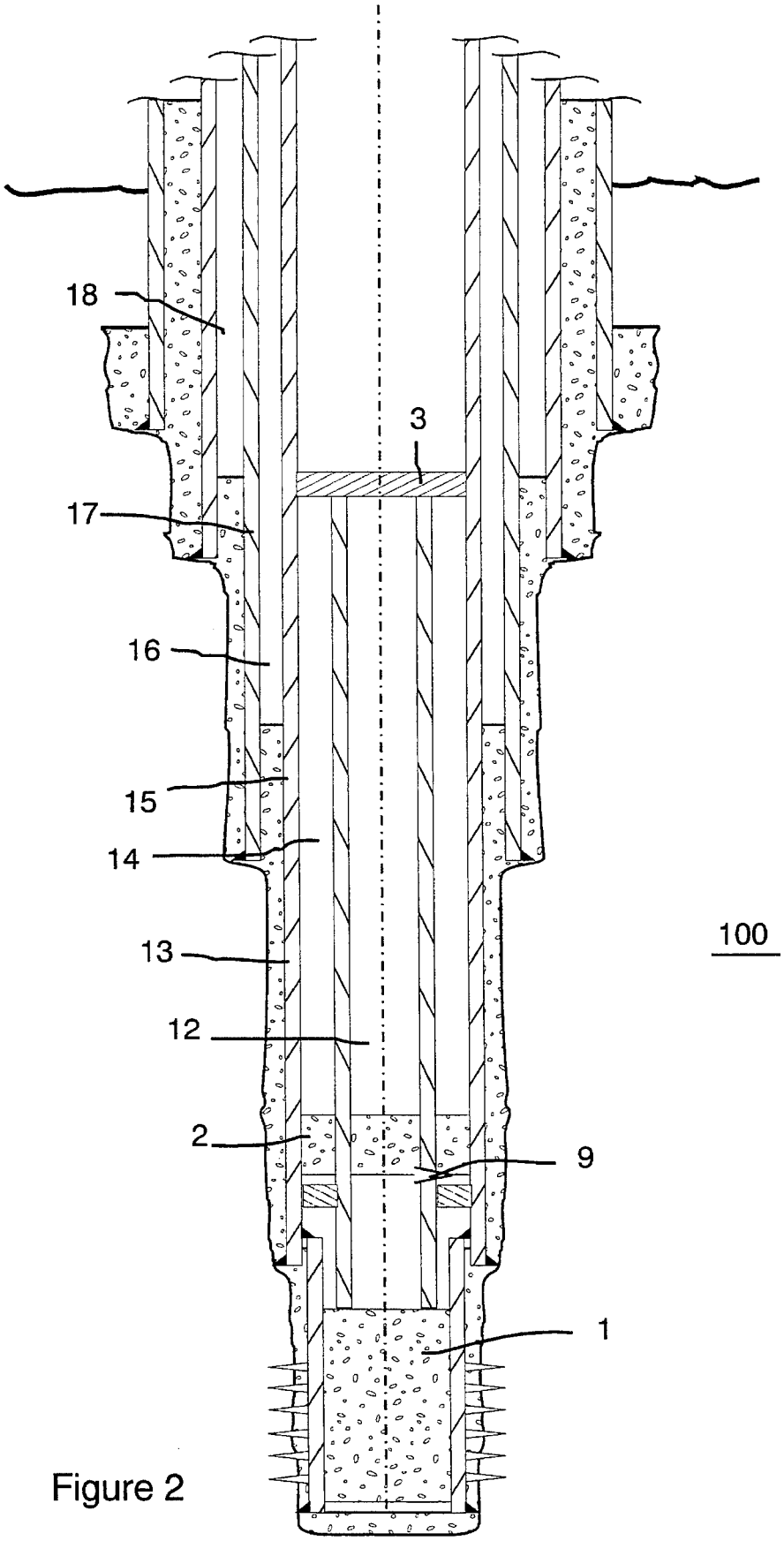
FIG. 2 is the same view as FIG. 1 showing steps 3 to 5 of a conventional well abandonment.
Figure 3:
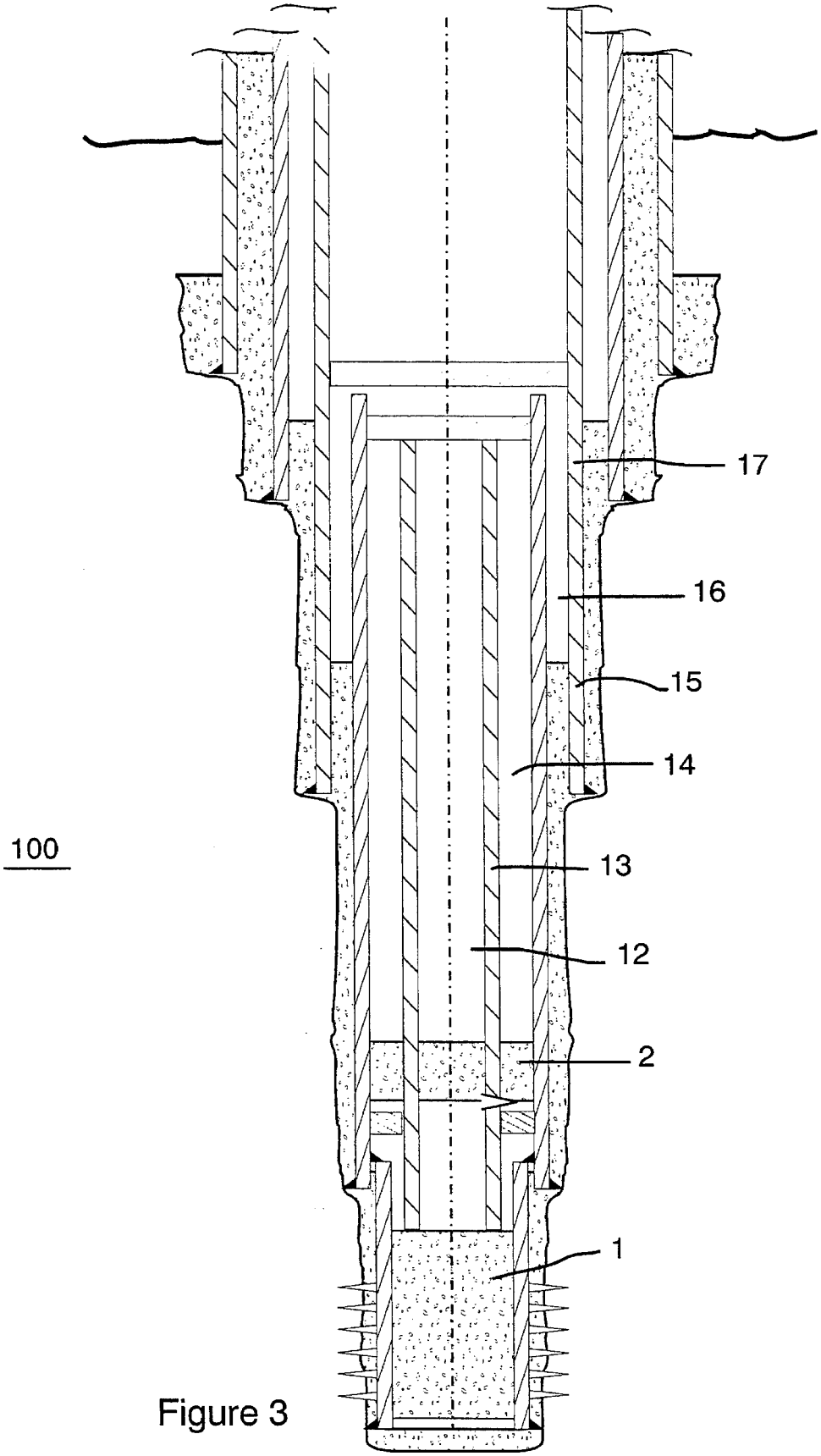
FIG. 3 is the same view as FIG. 1 showing steps 6 to 10 of a conventional well abandonment.

Referring to FIG. 2 the following steps are required:

1. A first seal 1 is made sealing the first production conduit 11 from the oil or gas reservoir.
2. A second seal 2 is made between the first conduit 11 and the second conduit 13.
3. The first conduit 11 is cut and removed from the well.
4. A seal 3 is made in the of the internal bore of the second conduit 13.
5. Perforations are made in the wall of the second conduit 13.
6. The contents of the second annual channel by means of suitable flushing material from the well head.
7. The wall of the second conduit 13 is cut.
8. The second conduit is removed from the well.
9. Steps 4 to 8 are repeated for the subsequent conduits.

Thus the total number of operations for the well described in this embodiment comprising merely five conduits is 23. Each step requiring several winching operations from the well head.

Figure 4:
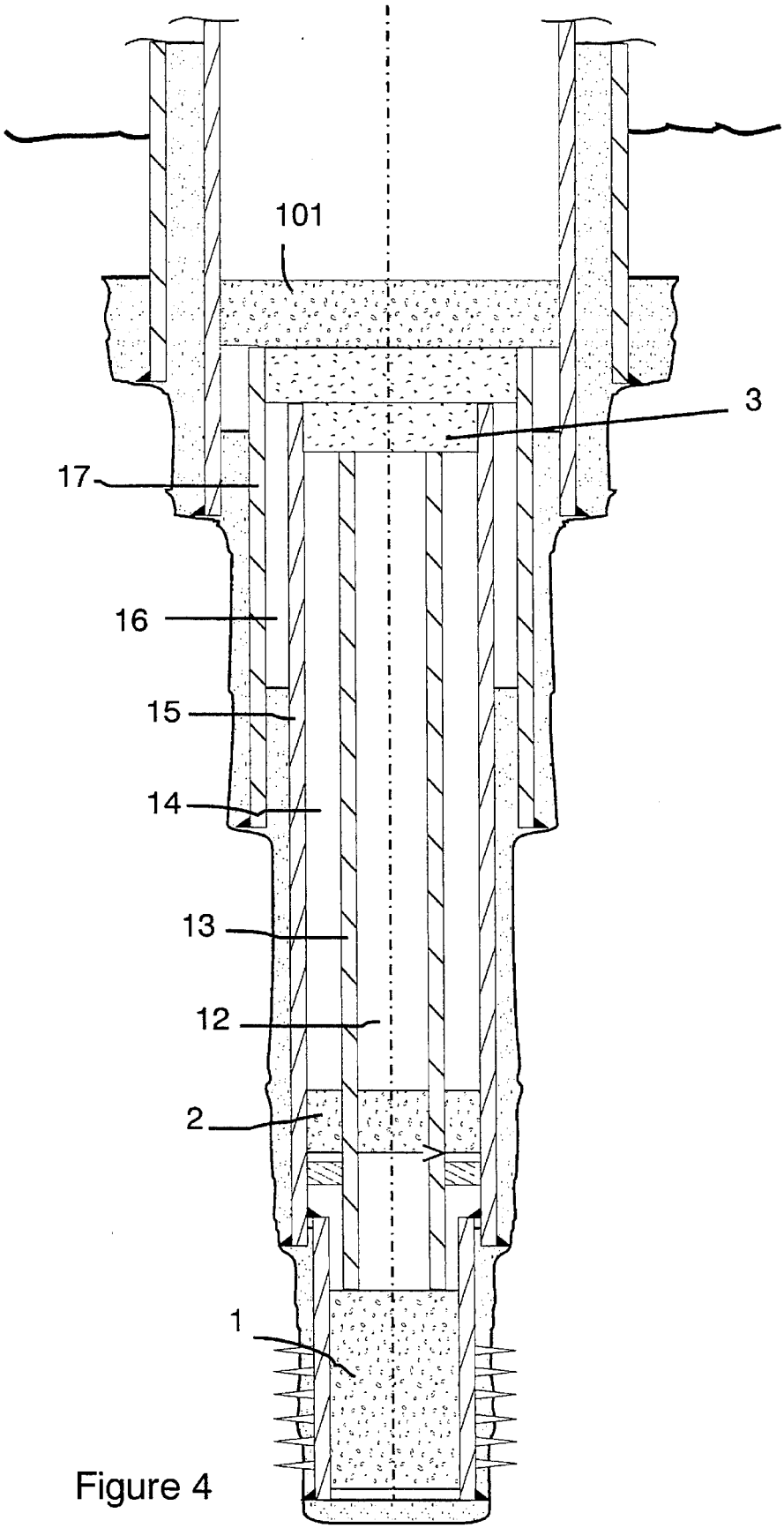
FIG. 4 is the same view as FIG. 1 showing steps 11 to 14 of a conventional well abandonment.

As shown in FIG. 4 a final seal of concrete 101 is made covering all the annular channels.

Figure 5:
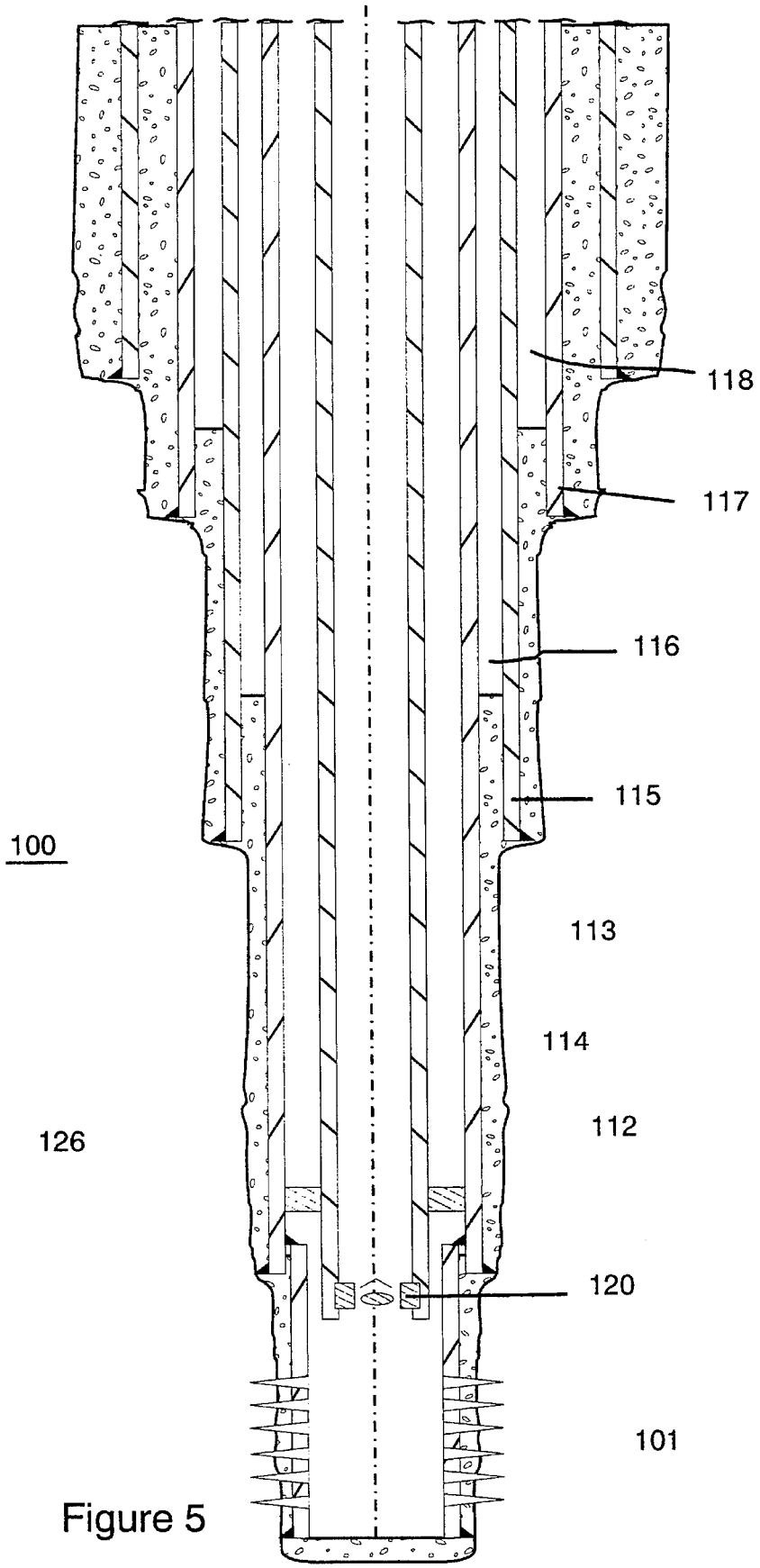
FIG. 5 is a side view of a typical well showing to be abandoned according to a first embodiment of the invention.

Referring now to FIG. 5 and subsequent figures a method of well abandonment is described according to an embodiment of the invention for the same well comprising five conduits.

In the method according to the invention the well fluids are to be pumped by applying pressure by means of a gaseous medium back down the well back into the reservoir. As a precaution, and before the pumping is commences a mechanical check valve 120 is positioned above the reservoir perforations 101 preventing flow from the reservoir. This mechanical check valve allows flow back into the reservoir but does not permit flow out of the reservoir up the production tubing. The purpose of the mechanical check valve 120, 123 is to prevent the return of the well fluids up the production tubing in the event that the pressure is lost for any reason.

Figure 6:
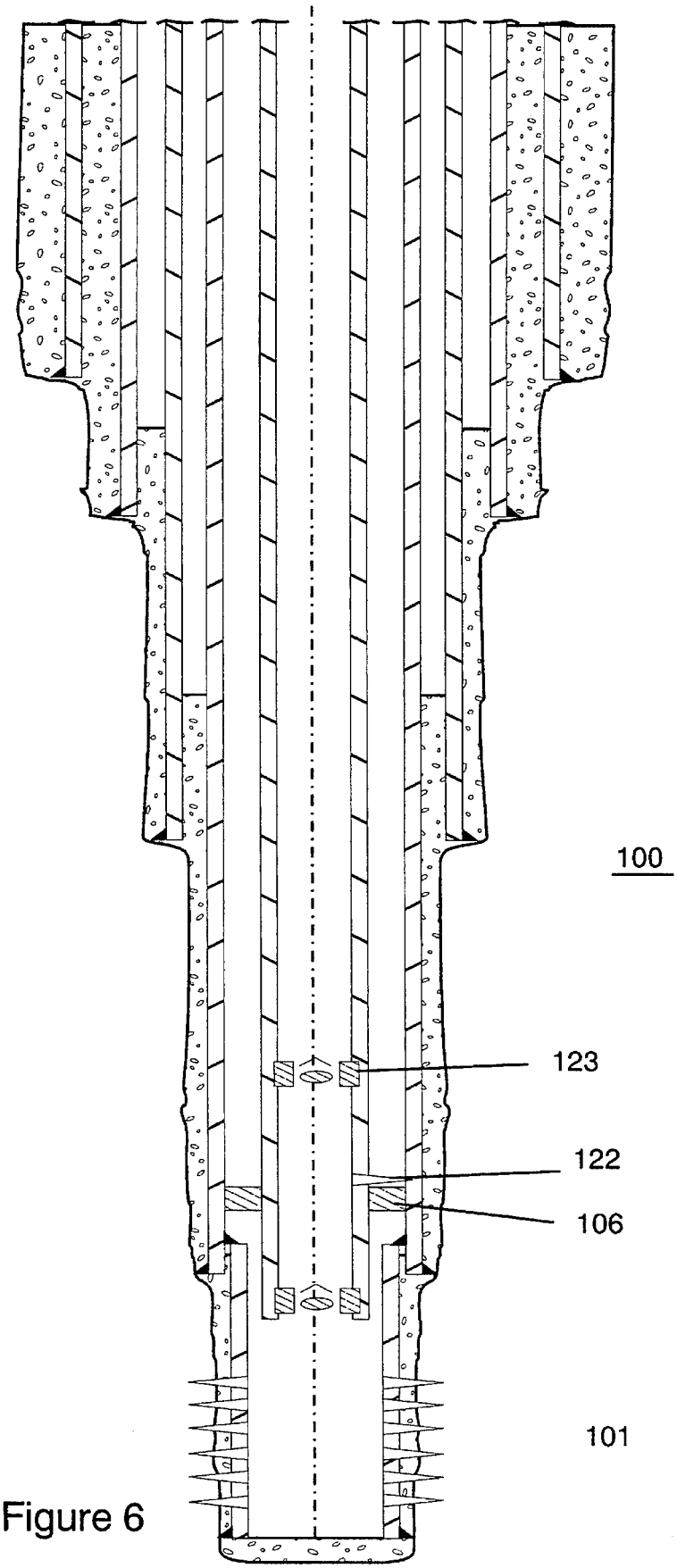
FIG. 6 is the same view as FIG. 5 according to a second embodiment of the invention.

Referring to FIG. 6 it can be seen that a perforation 122 is provided just above the production seal 106. This perforation connects the innermost conduit or production tubing 112 with the first annular layer 114. This allows the fluids in both the innermost conduit 112 and the first annular channel 114 to be pressurized back into the reservoir, provided there is access to the first annular channel further up the well and preferably at the surface. A second mechanical check valve 123 is then optionally provided above the perforation 122 to permit the pressurizing of the production tube 112 and the first annular channel in separate stages. The second mechanical check valve 123 is positioned at a determined distance above the first mechanical check valve 120 which will be used to confirm the amount of final hydraulic seal or cement (see below).

Further annular channels can be included in the pressurization and their fluids pressurized back into the reservoir if access to the annular channel is possible but this is not always the case.

In some cases it is not possible to access the first annular channel at the surface and also in some cases the inner conduit of production tubing 112 is sufficiently wide to contain the fluids drained from the remaining annular channels by means of the further steps of the method of the invention which will now be described. It may also be the case that it is only necessary to drain the first annular channel into the production tubing and the remaining channel can remain in the undrained condition. This would depend on the nature of the material within the further annular channels.

Figure 7:
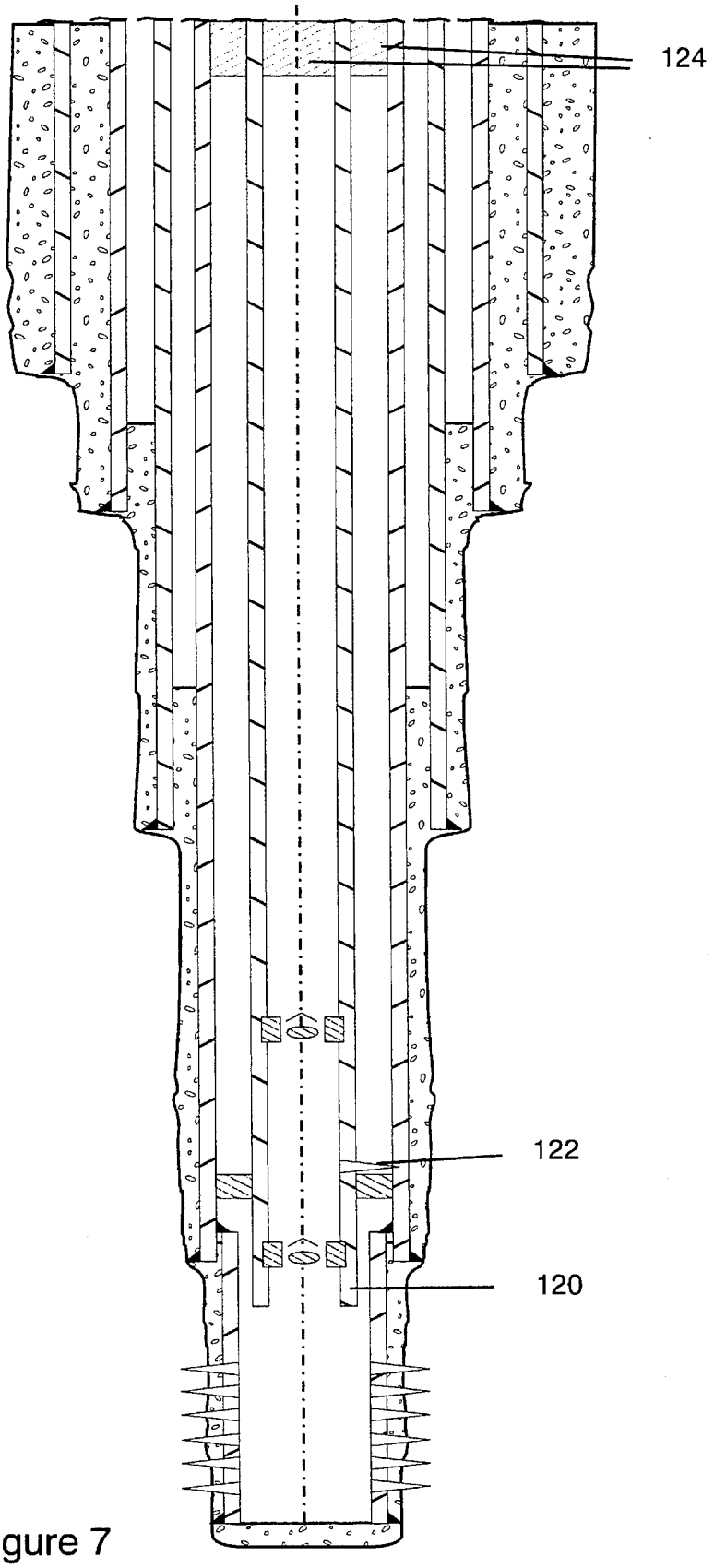
FIG. 7 is the same view as FIG. 5 showing a further step of the second embodiment of the invention.
Figure 8:
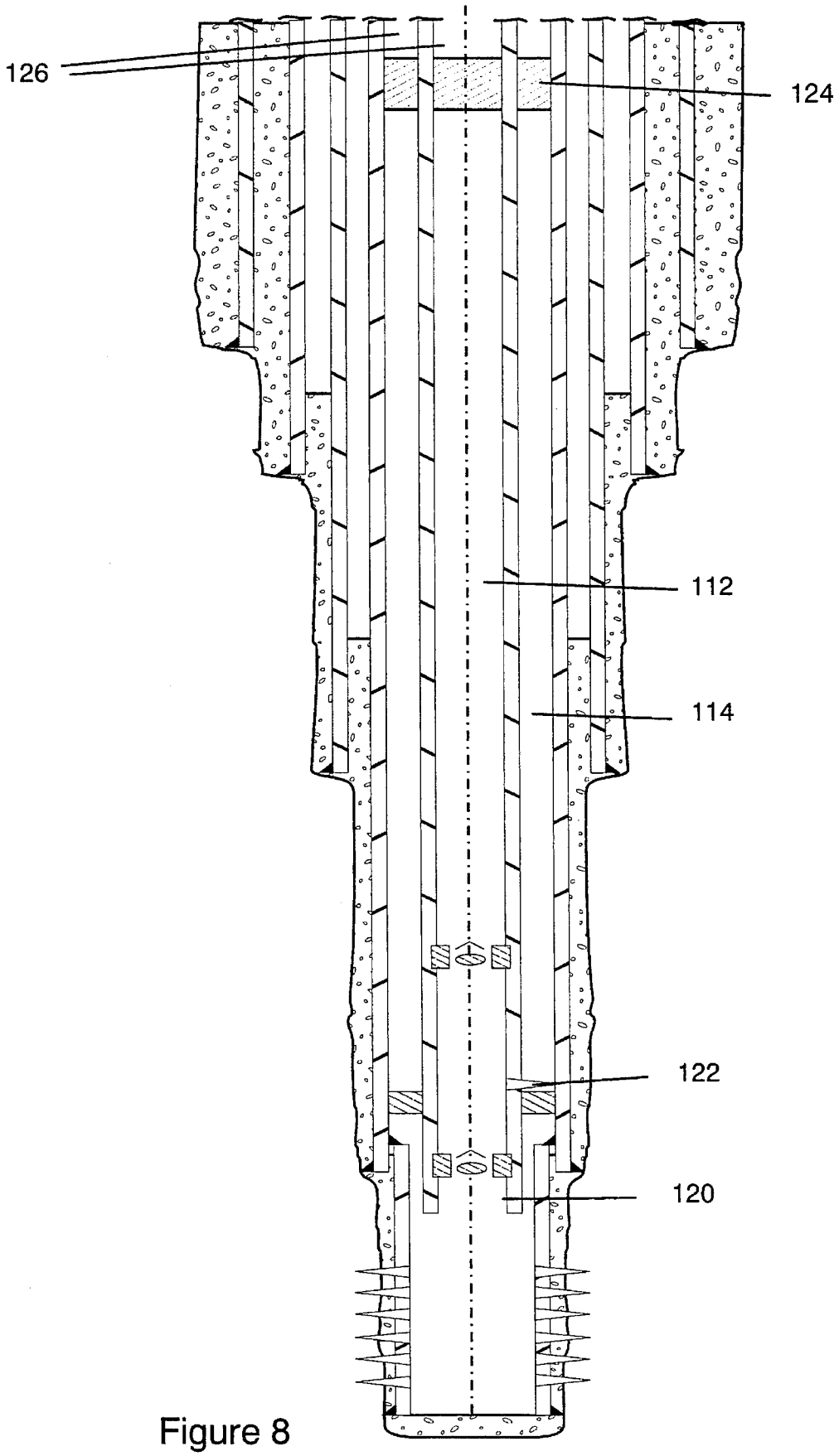
FIG. 8 is the same view as FIG. 5 showing a further step of the second embodiment of the invention.

Referring to FIG. 7 it can be seen that a hydraulic seal 124 is provided at the top of the innermost conduit or production tubing 112 and the first annular channel 114. The delayed acting hydraulic seal 124 is of a material which is flexible enough to slide down the production tubing while maintaining a seal. The seal may be provided by a delayed action cement or a suitable cross linked polymer. The seal could also conveniently be a solid plug type seal which seals as it moves down the well for example by means of rubber fins. The seal 124 forces the well fluids down the production tubing 112 and the first annular channel 114 by means of pressure applied above the seal 124. The medium by which the pressure is applied is a gaseous medium 126 such as nitrogen as shown in FIG. 8.

Figure 9:
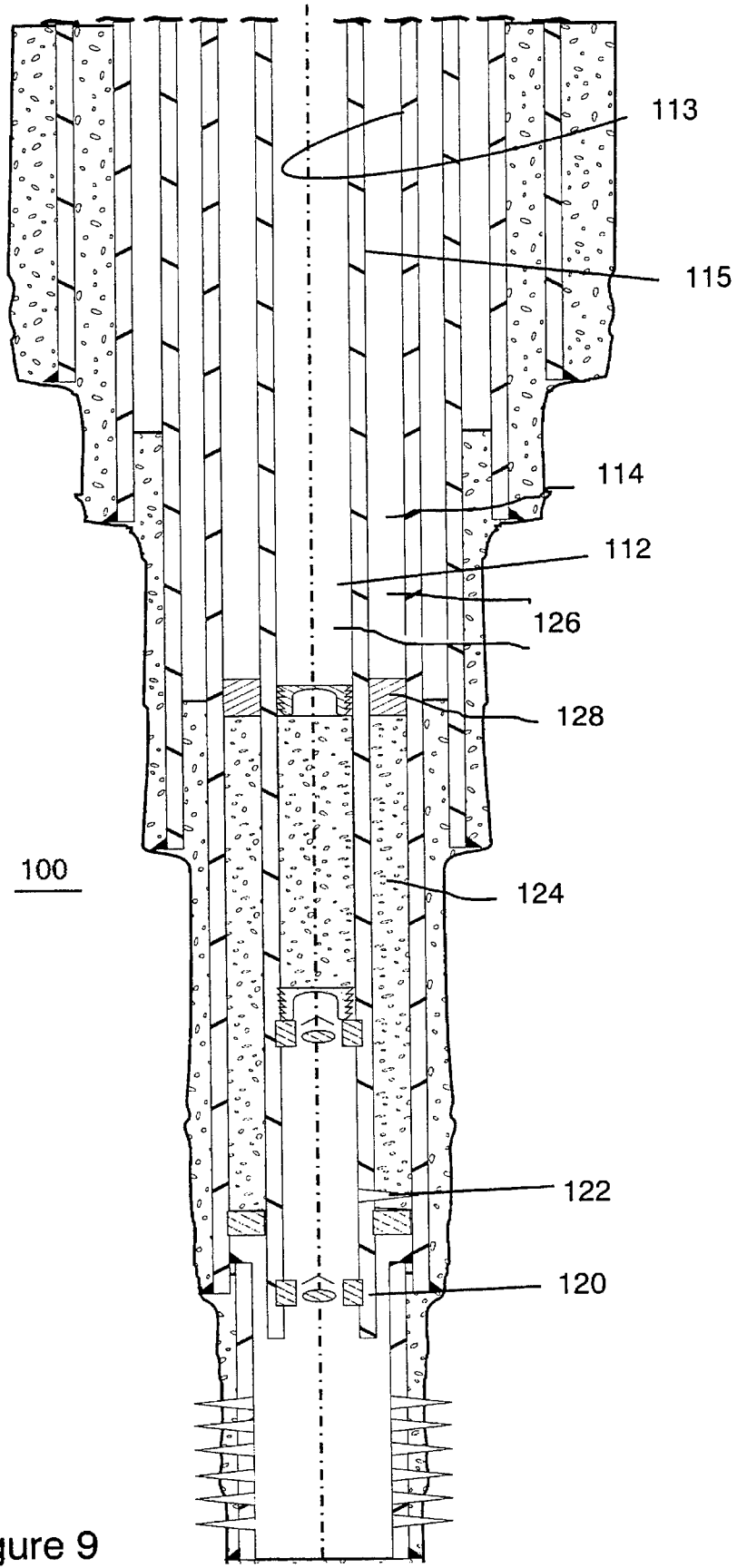
FIG. 9 is the same view as FIG. 5 showing a further step in the method of abandonment of a well according to the invention.
Figure 10:
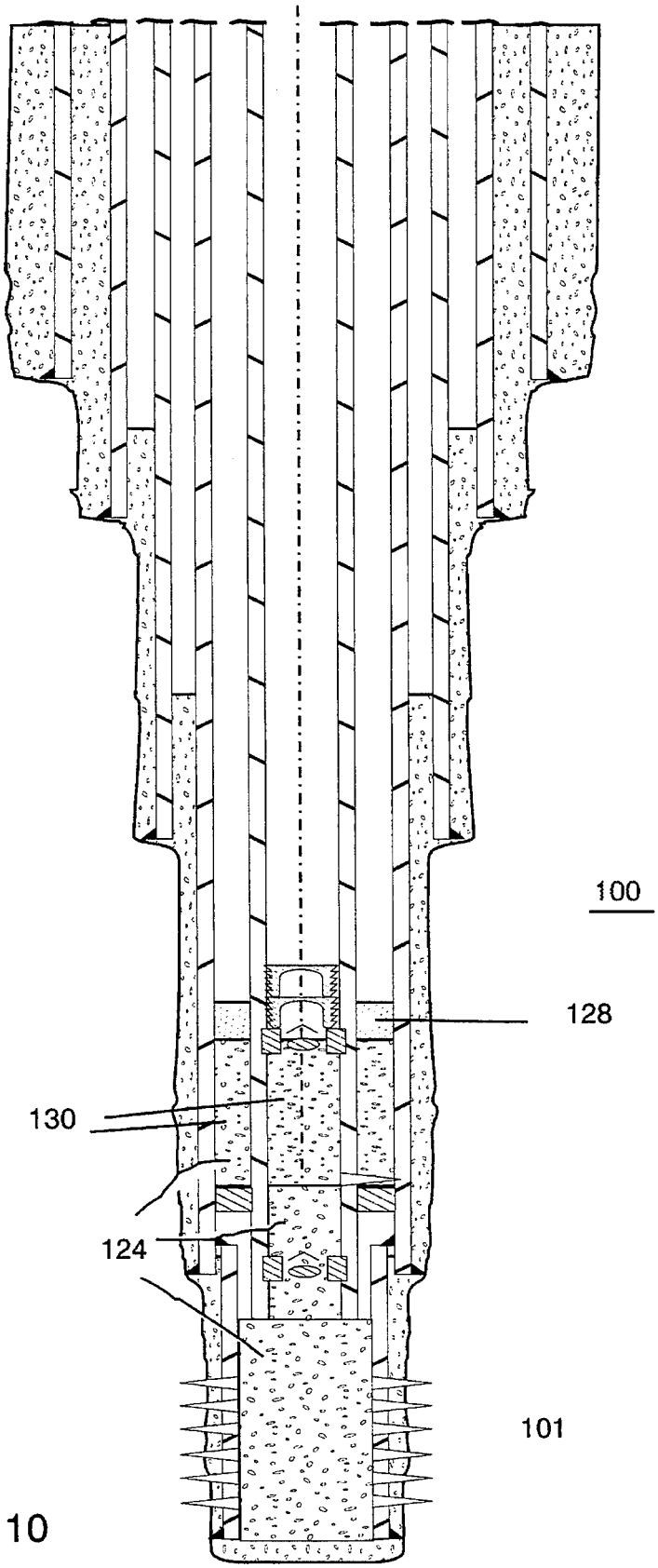
FIG. 10 is the same view as FIG. 5 showing a further step in the method of abandonment of a well according to the invention.

As shown in FIG. 9, if required, an elastomeric layer 128 may be provided above the seal 124 to prevent the sealing material from attaching itself to the side walls 113, 115 of the production tubing 112 and the first annular layer 114.

Figure 7A:
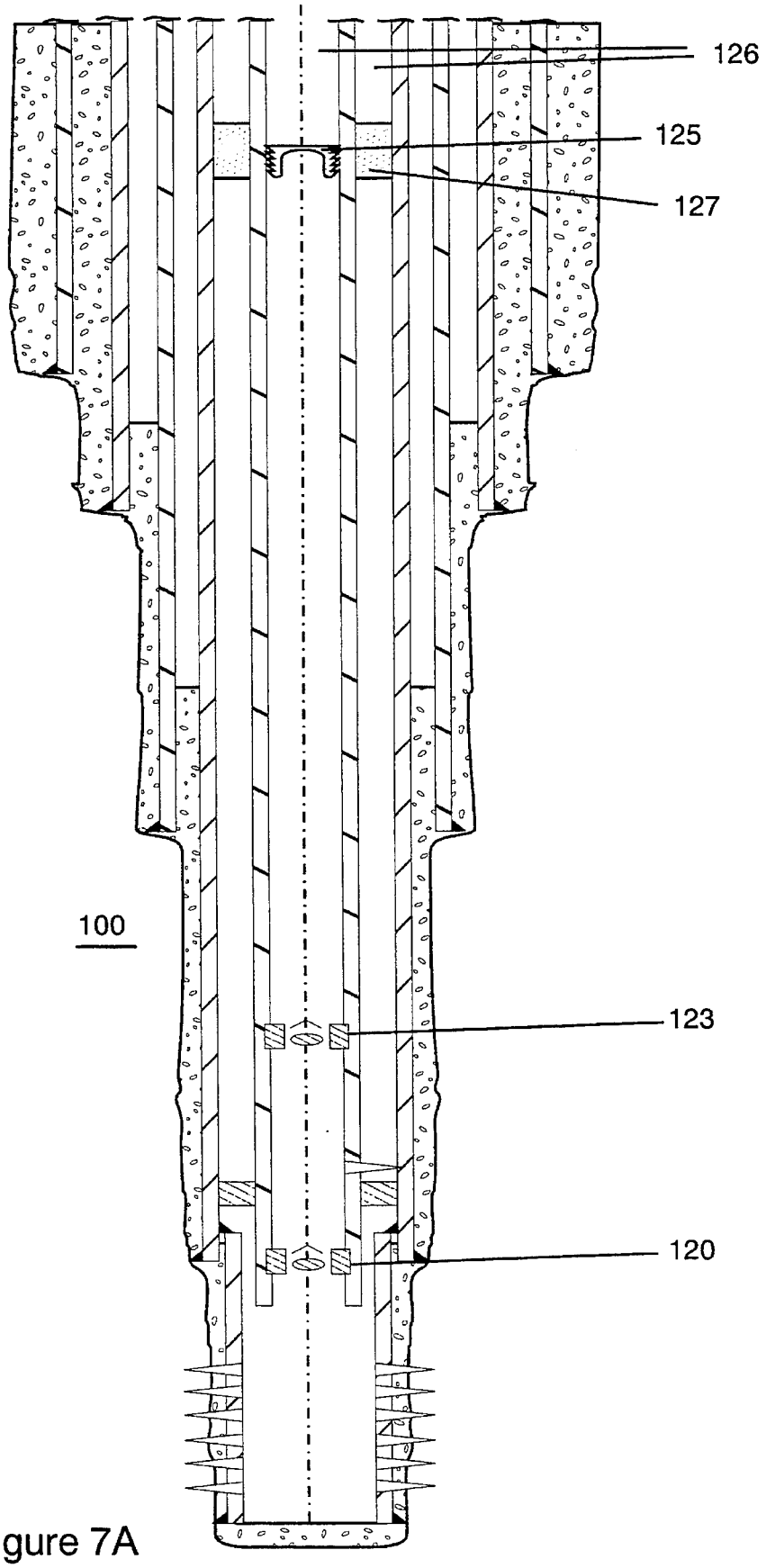
FIG. 7*a* is the same view as FIG. 5 showing a third embodiment of the invention.
Figure 8A:
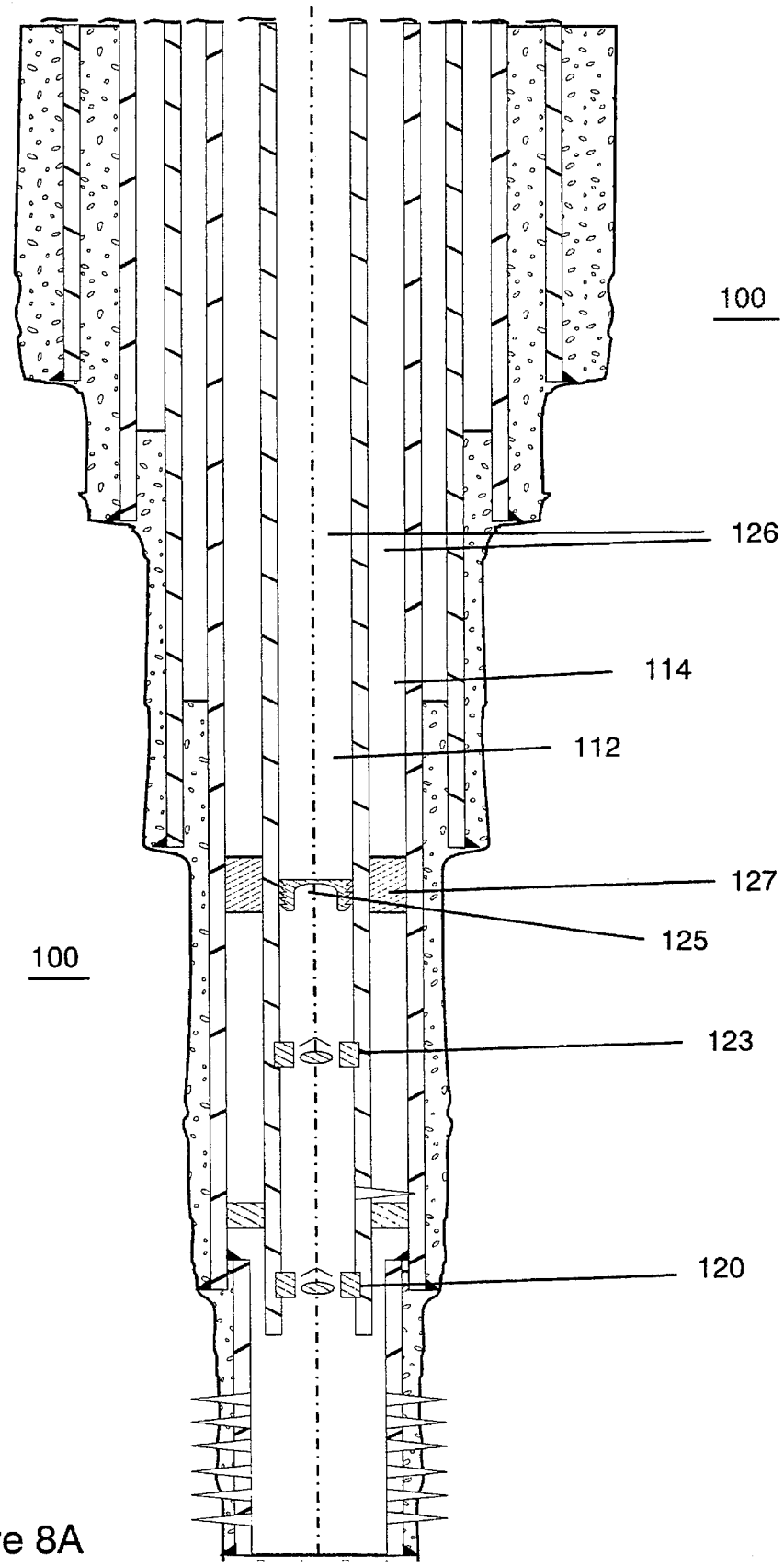
FIG. 8*a* is the same view as FIG. 5 showing a further step of the third embodiment.

Alternatively, referring to FIGS. 7*a* and 8*a*, the well fluids are pressurized by a gaseous medium and hydraulic seal means are provided ahead of the pressurizing gaseous medium such as a plug 125 or viscous gel 127 to ensure that the residual well fluids are pushed down, through the check valves 120, 123, into the reservoir. In the annular channel 114 for which it is not so easy to provide a plug of the required dimensions a flexible plug made of a viscous gel 127 such as can be provided by a cross linked gel can be used which has the desired effect of pushing the fluids down the annular channel with the pressurized gaseous medium behind it.

Once the well fluids have been forced down through the mechanical check valve 120, 123, as far as the reservoir perforations 101, cement is then pumped down. The plug 125 is preferably a burst disc assembly which permits the cement to pass through the mechanical check valves 120, 123 and into the lower part of the well. In the case of the hydraulic seal being a viscous gel the seal is forced through the mechanical check valve. A predetermined volume of cement is pumped according to the calculated volume of the well area in the region of the reservoir perforations 101 and of the inner conduit and first annular conduit up to the second mechanical check valve. The second mechanical check valve will typically be placed above the first mechanical check at a distance to ensure that the required amount of cement is provided in the inner conduit 112 and first annular channel 114. Such a distance would typically be 100 feet.

Immediately behind the cement a further plug 129 is pumped down. When this plug lands on the second mechanical stop valve 123 this can be detected at the surfacer by the indication of a sudden pressure build up and the pumping can be stopped. This will indicate that the cement has fallen down far enough to fill the required area in the region of the reservoir perforations 101 and also the required 100 feet of the inner conduit 112 and the first annular channel 114. The level of the cement in the first annular channel 114 will be approximately the same as the level of cement in the inner conduit 112. If additional cement is required in the first annular channel 114 then the required amount can be added.

Once the cement has set it can be pressure tested for any leakages into the reservoir to confirm that the well abandonment has been completed successfully.

An empty space is thus created in the production tubing 112 and the first angular channel 114. According to this embodiment of the invention this space is now used as a sump in which the fluids contained in the remaining annular channels 116, 118 etc can be drained.

Figure 11:
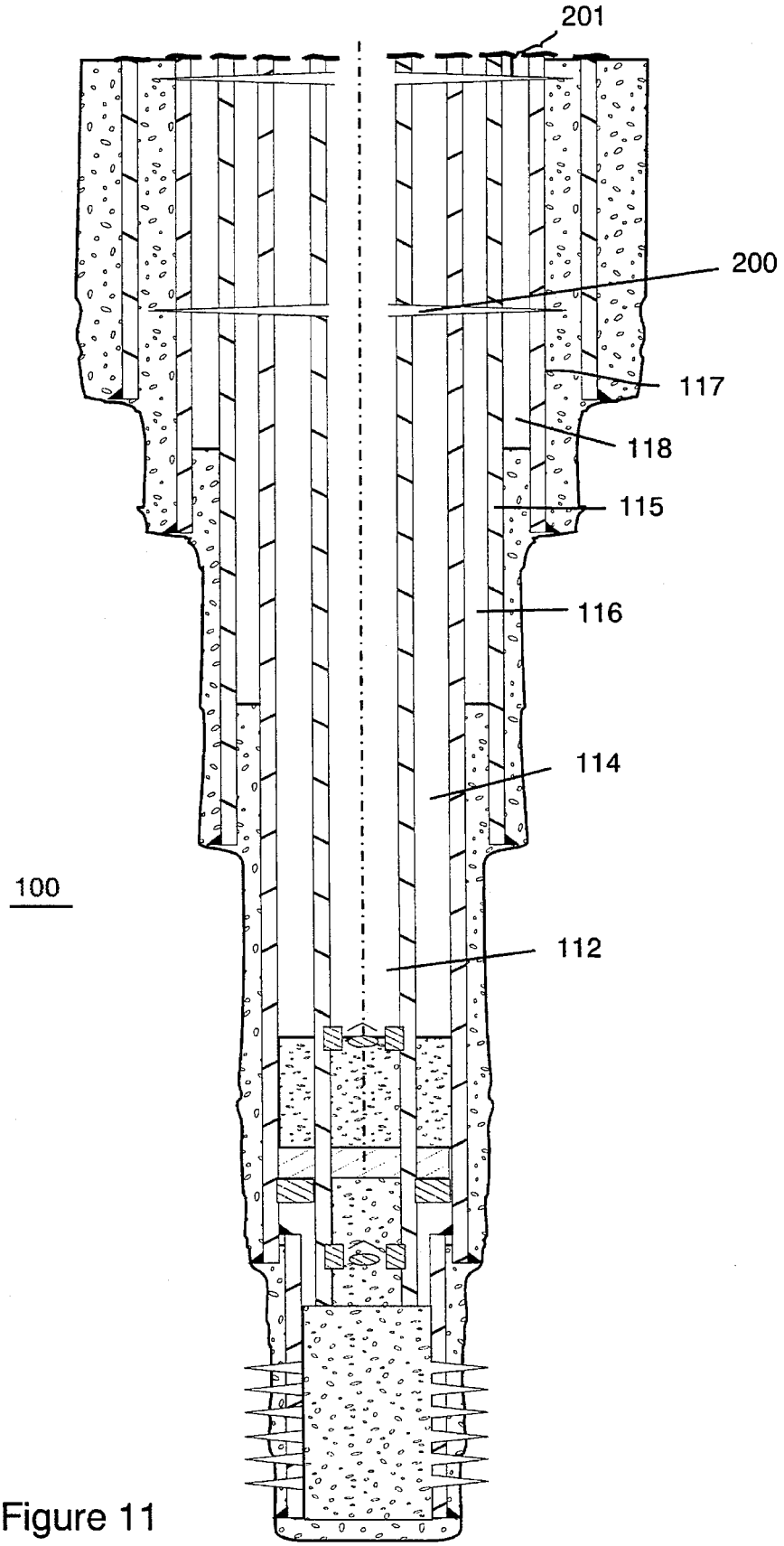
FIG. 11 is the same view as FIG. 5 showing a further step in the method of abandonment of a well according to the invention.

Thus referring to FIG. 11 it can be seen that by perforating through the further conduit walls 115, 117 etc the fluids in the remaining annual channels are permitted to flow into the space in the production tubing 112 and first annular channel 114. The perforations are made further up the well at point, which can be accurately calculated, at which there is sufficient volume in the production tubing 112 and first annular channel 114 to contain all the fluids contained in the remaining channels.

Figure 12:
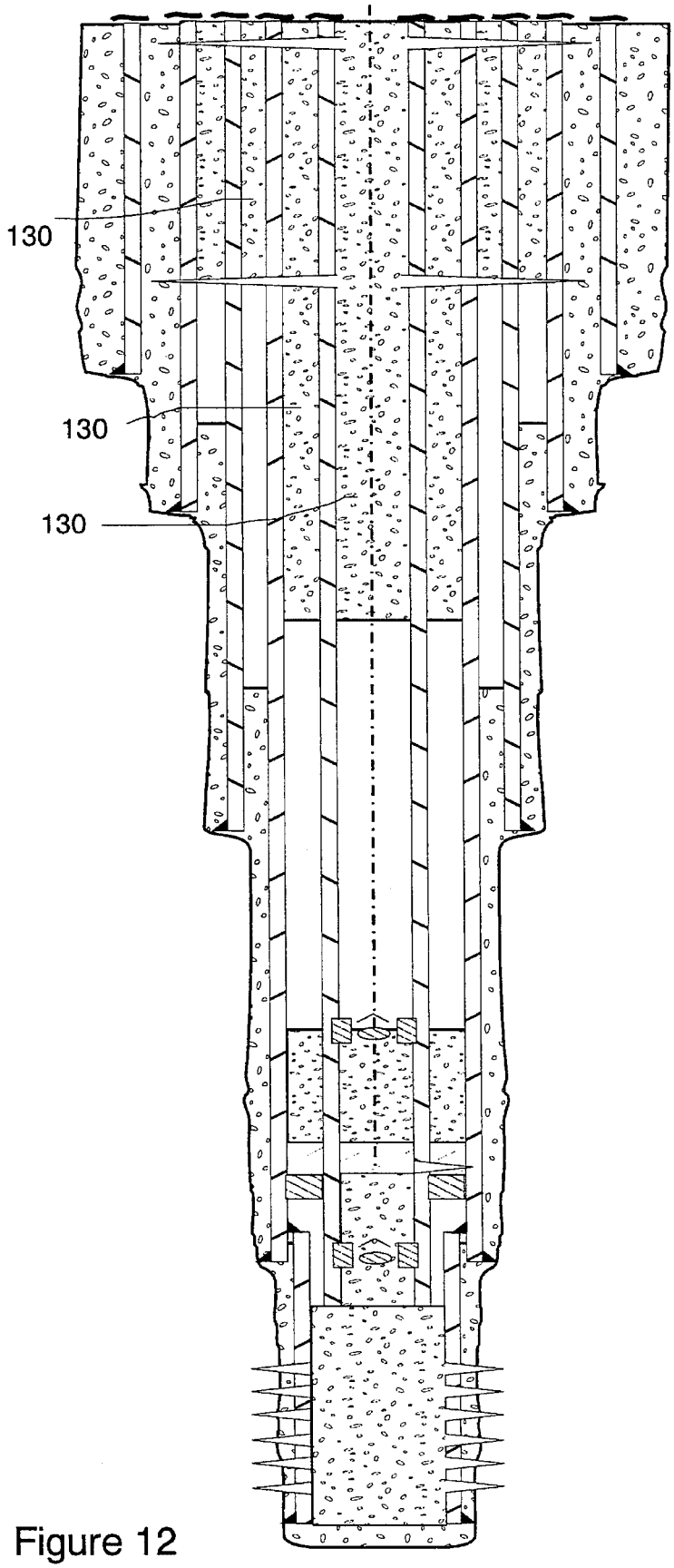
FIG. 12 is the same view as FIG. 5 showing a further step in the method of abandonment of a well according to the invention.

Referring to FIG. 12 it can be seen that a further seal 130 can then be provided across all the channel of the well, which are now inter connected by means of the last perforations, so that the entire well is completely sealed.

Thus by reference to FIGS. 5 to 12 one embodiment of the method of abandoning a well according to the invention is as follows:

1. Position first mechanical check valve 120.
2. Pressurize inner conduit 112 with nitrogen through mechanical check valve 120 into the reservoir by means of a burst disc plug assembly.
3. Perforate the inner conduit 112 immediately above the well packer.
4. Position second mechanical check valve 123 100 feet above first mechanical check valve 120.
5. Introduce second burst disc plug 126 and pump cross linked gel 128 into the first annular channel 114.

6. Pressurize the inner conduit 112 and the first annular channel 114 simultaneously contents with nitrogen until the second plug lands on the second mechanical check valve 123.
7. Pump cement into the inner conduit 112 and first annular channel 114 using a third plug and a cross linked gel in the annular channel if necessary.
8. Pressurization of the cement is continued until the third plug lands on the second plug. Test when set.
9. Perforate all upper conduit to drain all remaining annular channels into the nitrogen sump formed by the inner conduit and the firs annular channel.
10. Pump cement into all upper annular channels. Test when set.

If necessary all the conduits can then be removed above the final seal 130 by any suitable known means.

Figure 13:
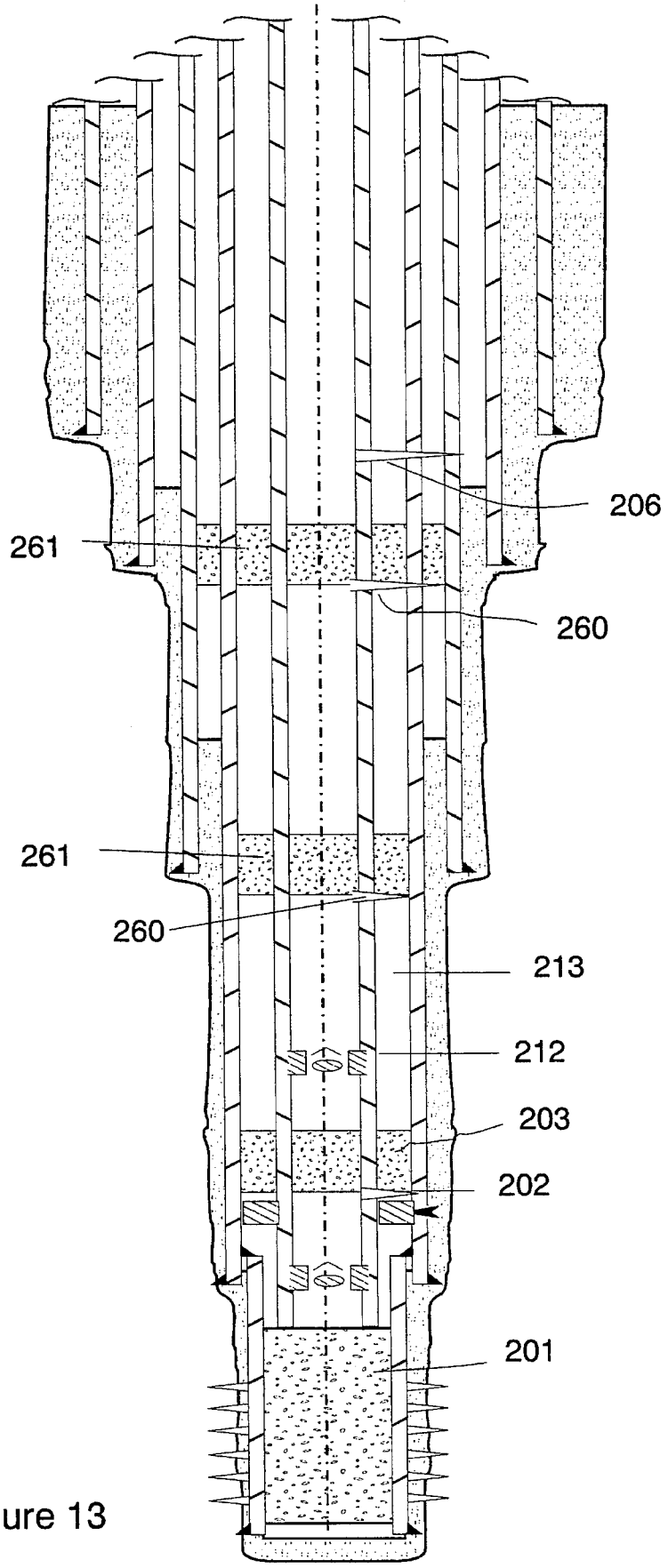
FIG. 13 is a side view of a well to be abandoned according to a third embodiment of the present invention.
Figure 15:
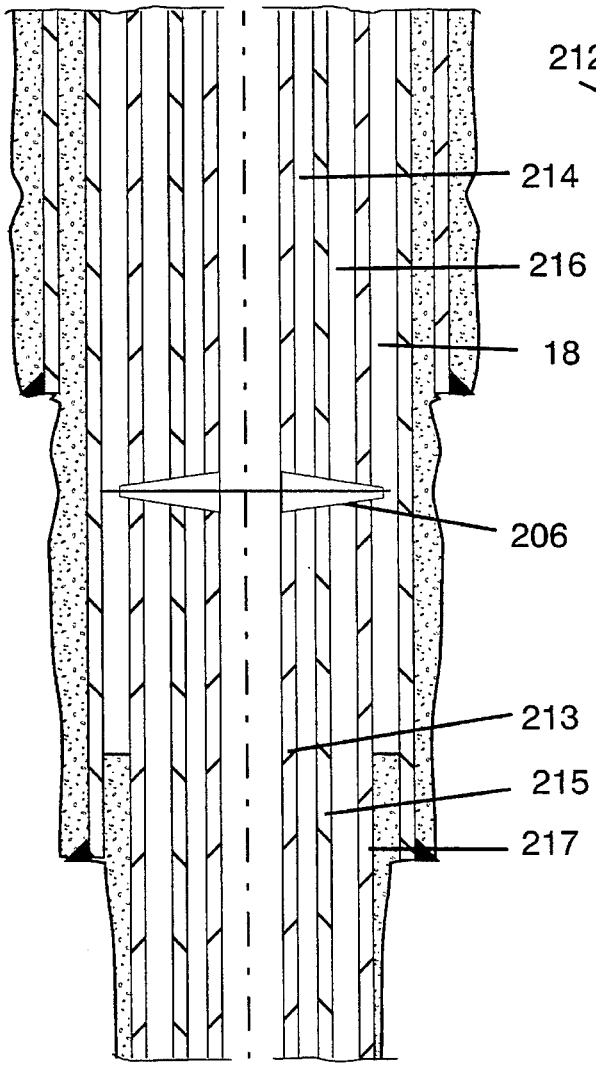
FIG. 15 is a more detailed side view of the well in FIG. 13 in the region of the perforations.

A further embodiment of the present invention is shown in FIGS. 13 to 19. In this embodiment the production tubing 212 is sealed and removed in the same way as is presently known. The subsequent steps of the conventional method are replaced by the following steps of the method according to the invention:

As shown in FIGS. 13 and 15, at a suitable location perforations 206 are made in all of the remaining four conduits using a suitable perforating tool which may be lowered on a wire line in a known way.

Figure 16:
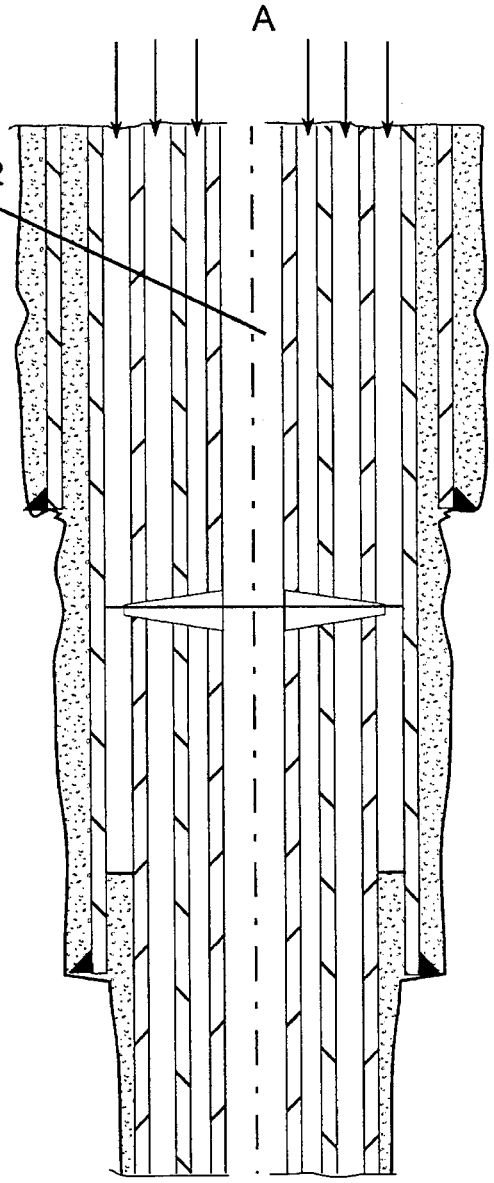
FIG. 16 is the same view as FIG. 15 showing the purging of the well.

As shown in FIG. 16 a purging material such as nitrogen is then pumped down the remaining annular channels from the well head in the direction of the arrows A to displace the contents of the annular channels through the perforations and up through the central channel 212 for safe removal without effecting the environment.

Figure 17:
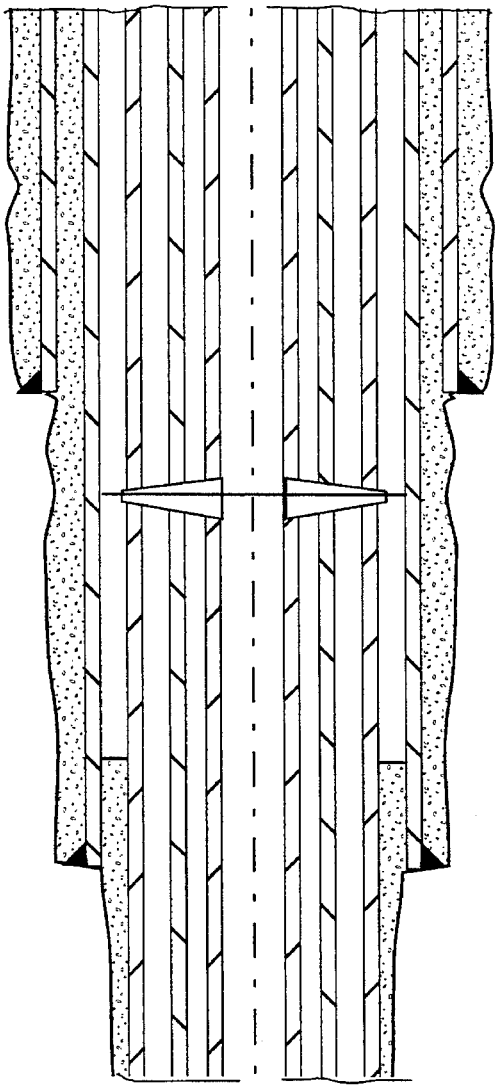
FIG. 17 is the same view a FIG. 15 showing a further step of the third embodiment in more detail.
Figure 18:
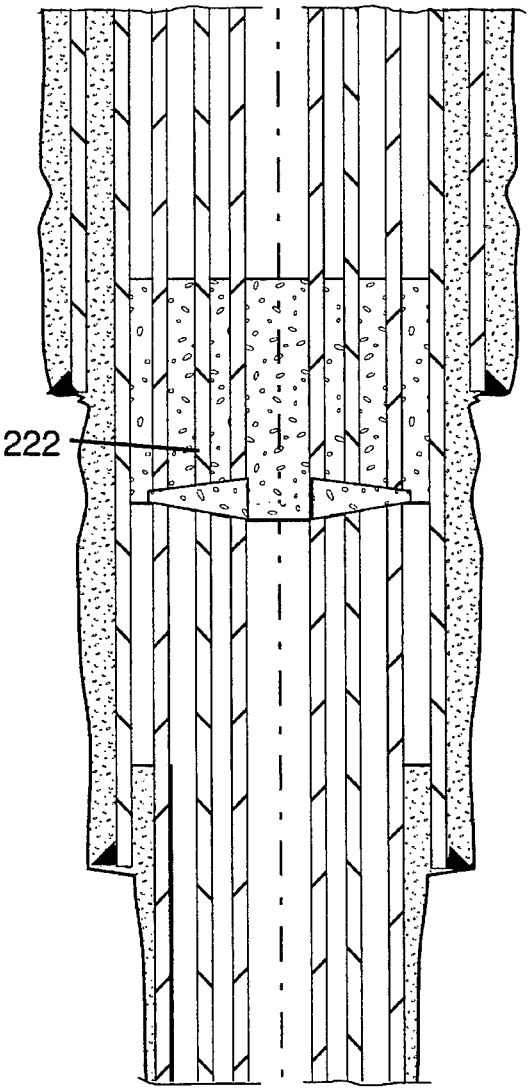
FIG. 18 is the same view as FIG. 15 showing a further step of the third embodiment of the present invention.
Figure 19:
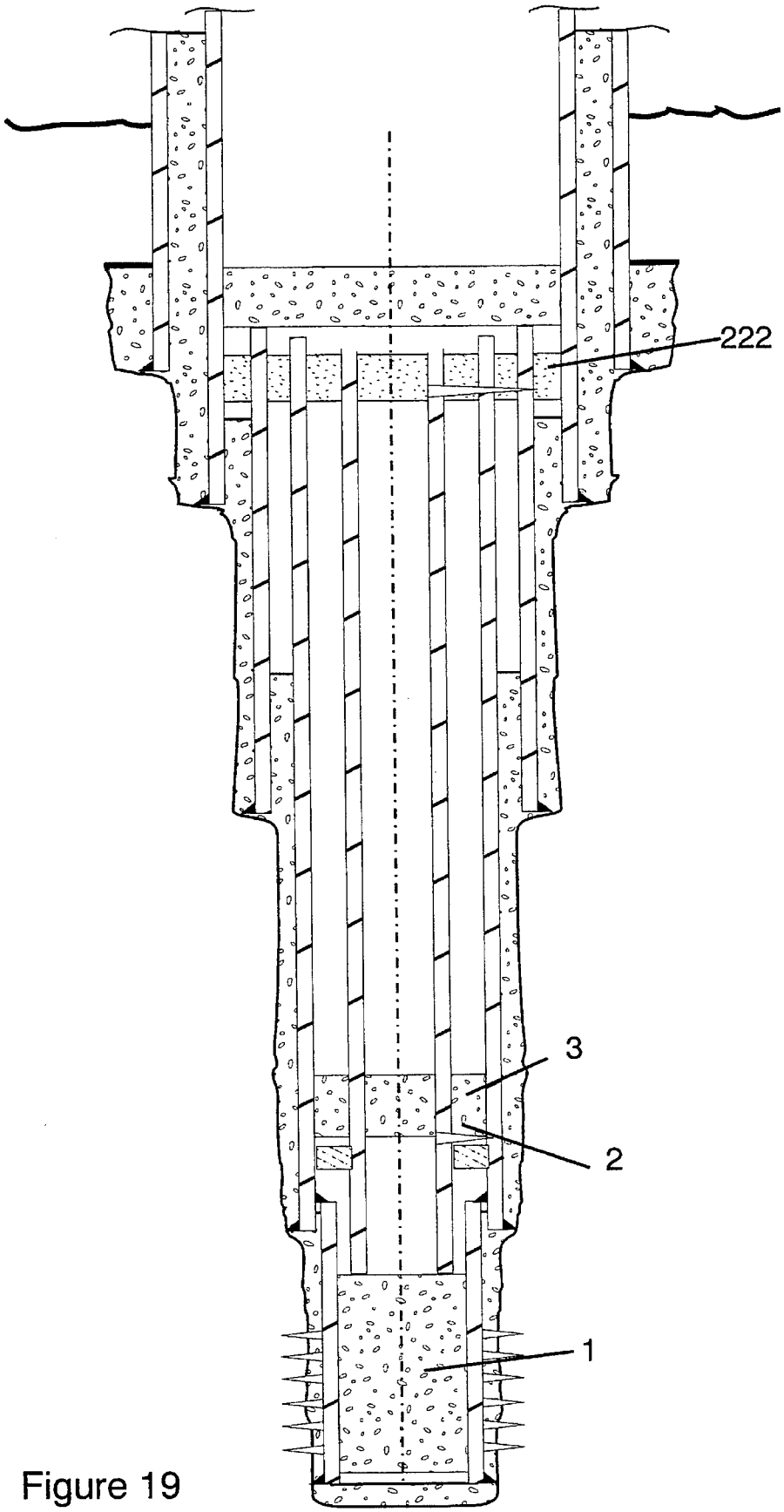
FIG. 19 is the same view as FIG. 13 showing further steps of the third embodiment of the invention.

Cement is then pumped down the annular channels from the well head thus providing a seal across all the annular channels in the region of the perforations 206. Thus the whole well can be made completely safe in one application of concrete 222 as shown in FIGS. 17 and 18.

All the remaining conduits can then be cut and removed one by one by any suitable known manner.

Thus it can readily be seen that by means of the method of well abandonment according to the invention the time and number of separate operations required for completion of the abandonment of a well compared to the conventional method are considerably reduced.

Figure 14:
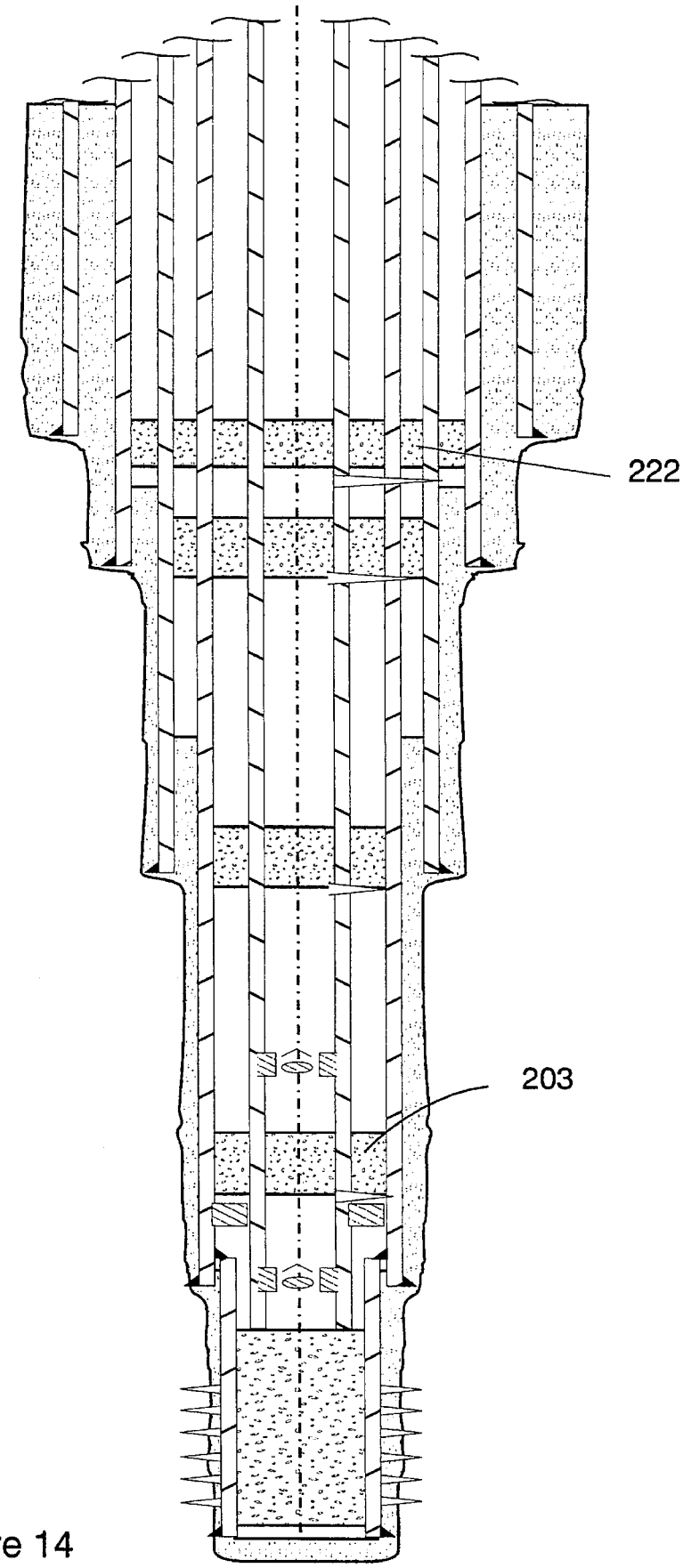
FIG. 14 is a side view of a well to be abandoned showing further steps of the method according to the third embodiment of the invention.

Referring to FIGS. 13 and 14 in conjunction with FIG. 15, according to this embodiment a means is required for pumping cement to the required location following perforation and this may be provided by means of a combined perforating and plugging device as follows:

a. The conduit perforating and plugging device is lowered to the position in the central conduit where the cement plug is required,
b. the conduit wall is perforated,
c. the central conduit is sealed at the well head to prevent back flow of the sealing cement,
d. the annular channel in which the cement plug is to be located is left unsealed at the well head to permit the cement to pass through to the annular channel,
e. cement is then pumped through the perforations in the conduit wall to form the required plug displacing the material present.

Sealant may be pumped in the region of the central conduit surrounding the conduit perforating and plugging device and left to form a balanced plug across the central conduit as the conduit perforating and plugging device is removed.

It will be apparent to any one skilled in the art that a plug may be formed at any annular channel by continuing the perforation through as many conduit walls as required at any required position in the well. The plug will be formed by pumping the required amount of cement to the required location with the appropriate annular channels either sealed or left open at the well head.

What is claimed is:

1. A method of abandoning a well, said well comprising at least two concentric conduits having at least one annular channel therebetween, and an innermost channel which contain well fluids and other fluids associated with oil production, said method comprising the steps of:

(a) applying pressure in the innermost channel of the well by means of a gaseous medium in order to force the well fluids back into a reservoir communicating with the well to create a void which is filled by the gaseous medium; and (b) perforating at least an inner one of said concentric conduits to allow the fluids contained in the at least one annular channel to drain into the void created by the gaseous medium.

2. The method of abandoning a well according to claim 1 wherein a hydraulic seal is provided in the innermost channel prior to the application of pressure by the gaseous medium therein.

3. The method of abandoning a well according to claim 2 wherein a layer of elastomeric material is located above the hydraulic seal prior to the application of pressure by the gaseous medium.

4. The method of abandoning a well according to claim 2 wherein pressure is applied by means of the gaseous medium until the level of the well fluids fall back to a region of the reservoir and the pressure is maintained until the hydraulic seal is set, whereupon the pressure is released.

5. The method of abandoning a well according to claim 4 wherein a further second hydraulic seal is applied above the first-mentioned hydraulic seal to complete the sealing of the well.

6. The method of abandoning a well according to claim 2 wherein the hydraulic seal is a delayed action hydraulic cement seal.

7. The method of abandoning a well according to claim 2 wherein the hydraulic seal is a delayed action hydraulic cross linked polymer seal.

8. The method of abandoning a well according to claim 2 wherein the hydraulic seal is a solid plug seal.

9. The method of abandoning a well according to claim 1 wherein a plug is provided in said at least one annular channel.

10. The method of abandoning a well according to claim 9 wherein said plug is a burst plug disc assembly.

11. The method of abandoning a well according to claim 9 wherein said plug is a high viscosity gel.

12. The method of abandoning a well according to claim 11 wherein said plug is a cross linked gel.

13. The method of abandoning a well according to claim 9 wherein following pressurization, cement is supplied to the well in the gaseous medium.

14. The method of abandoning a well according to claim 13 wherein following pressurization, the cement passes through the plug.

15. The method of abandoning a well according to claim 1 wherein at least one further conduit is perforated at a point above the level of the well fluids in the innermost channel in order to drain the fluids in at least one further annular channel into the innermost channel and into any other annular channel between said further annular channel and the innermost channel.

16. The method of abandoning a well according to claim 15 wherein the at least one further channel is perforated at a point above the level of the well fluids in the innermost channel that there is sufficient volume in the innermost channel in any annular channels connected thereto by perforations, that when the fluids contained in the at least one further annular channel drain into the innermost channel and other annular channels connected thereto, a resulting level of fluids remains below the point of perforation of the at least one further channel.

17. The method of abandoning a well according to claim 1 wherein a mechanical check valve is provided at a lower end of the innermost channel which permits flow into the reservoir but prevents flow back up the innermost channel.

18. The method of abandoning a well according to claim 17 wherein a second mechanical check valve is provided at a lower end of the innermost channel at a predetermined distance above the first-mentioned mechanical check valve.

19. The method of abandoning a well according to claim 1 wherein the gaseous medium is nitrogen.

20. A method of abandoning a well, said well comprising at least two concentric conduits having at least one annular channel therebetween, and an inner channel which contain well fluids and other fluids associated with oil production, which comprises the steps of:

(a) perforating an inner one of said concentric conduits to connect the innermost channel with said annular channel; and (b) applying pressure in the innermost channel and in said annular channel by means of a gaseous medium in order to force the well fluids back into a reservoir communicating with the well to create a void which is filled by the gaseous medium.

* * * * *